US007881490B2

(12) United States Patent
Chiba et al.

(10) Patent No.: US 7,881,490 B2
(45) Date of Patent: Feb. 1, 2011

(54) SPEAKER DEVICE

(75) Inventors: Satoshi Chiba, Yamagata (JP); Shunichi Hiramuki, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 1148 days.

(21) Appl. No.: 11/545,759

(22) Filed: Oct. 11, 2006

(65) Prior Publication Data

US 2007/0081692 A1 Apr. 12, 2007

(30) Foreign Application Priority Data

Oct. 11, 2005 (JP) ..... 2005-296659

(51) Int. Cl.
*H04R 25/00* (2006.01)

(52) U.S. Cl. ..... 381/433; 381/396; 381/397

(58) Field of Classification Search ..... 381/396–397, 381/400, 412, 423, 431, 433
See application file for complete search history.

(56) References Cited

U.S. PATENT DOCUMENTS

| | | | | |
|---|---|---|---|---|
| 4,520,237 | A | 5/1985 | Murakami | |
| 5,909,015 | A | 6/1999 | Yamamoto et al. | |
| 6,430,300 | B1 | 8/2002 | Cox et al. | |
| 6,804,366 | B2 * | 10/2004 | Takahashi et al. | 381/397 |
| 7,201,252 | B2 * | 4/2007 | Nevill | 381/349 |

FOREIGN PATENT DOCUMENTS

| | | |
|---|---|---|
| JP | 53-129023 | 11/1979 |
| JP | 57-23395 | 2/1982 |
| JP | 58-53299 | 3/1983 |
| JP | 3-220897 | 9/1991 |
| JP | 3-239099 | 10/1991 |
| JP | 6-178390 | 6/1994 |
| JP | 2002-171596 | 6/2002 |
| JP | 2004-266607 | 9/2004 |
| WO | 92/21217 | 11/1992 |

* cited by examiner

*Primary Examiner*—Suhan Ni
(74) *Attorney, Agent, or Firm*—Nixon & Vanderhye, PC

(57) ABSTRACT

A speaker device includes a magnetic circuit, a vibration system, a frame and a terminal. The frame is formed into a frame shape, and an inner wall thereof holds the magnetic circuit. Particularly, the frame has an opening for ventilation, which makes a rear surface positioned on a side opposite to a sound output direction and a side surface curved to a direction of the sound output direction from a peripheral end of the rear surface communicate with each other, and the terminal covers the opening on the rear surface of the frame. Therefore, the opening is provided on the side surface of the frame, and ventilation performance of the speaker device is ensured. In addition, by such amount that no opening is provided on the rear surface of the frame, a setting space of the terminal can be enlarged on the rear surface of the frame.

4 Claims, 13 Drawing Sheets

SPEAKER DEVICE

BACKGROUND OF THE INVENTION

1. Field of the Invention

The present invention relates to a mounting configuration of a frame and a terminal for a speaker device.

2. Description of Related Art

Recently, a speaker device is used for various kinds of information equipments such as a mobile phone, PDA (Personal Digital Assistants) and a laptop personal computer.

The speaker device includes a magnetic circuit having a yoke, a magnet and a plate, a vibration system having a voice coil and a diaphragm, and a frame. In addition, the speaker device has a terminal connected to a lead wire of the voice coil and an external circuit at appropriate positions on the frame. Therefore, in the speaker device, at the time of operation thereof, an audio signal and power are supplied to the voice coil via the terminal and the lead wire of the voice coil from the external circuit, and an acoustic wave is emitted by the diaphragm.

As the speaker device of this kind, there is known an external-magnet type speaker device capable of appropriately releasing the air and realizing enlargement of a magnet to improve sensitivity (see Japanese Patent Application Laid-open under No. 2002-171596 (Reference-1), for example). The speaker device according to Reference-1 includes a ventilation hole at a predetermined position on a side surface of a supporting frame, through which the air therein is appropriately released. Thereby, a diaphragm can smoothly move. At the same time, by setting a position of a side surface (outer circumference) of an external magnet to a position on an inner wall of the supporting frame, a large magnet can be used. As a result, the sensitivity is improved.

In the speaker device of this kind, at the time of the operation thereof, the voice coil is heated, and a temperature of an area there around becomes high, which problematically causes sensitivity deterioration. A speaker device capable of solving such a problem is disclosed in U.S. Patent Applications Laid-open under U.S. Pat. No. 5,909,015 (Reference-2) and U.S. Pat. No. 6,430,300 (Reference-3), for example.

In the speaker device according to Reference-2, plural ventilation holes are formed on a plate, and each of the ventilation holes communicates with a central opening of a pole piece via an air gap. Therefore, at the time of operation thereof, the air flows in and out between an inside of the speaker device and an outside thereof via each of the ventilation holes, the air gap and an air passage at the central opening of the pole piece, and the speaker device is thereby cooled down.

In addition, in the speaker device according to Reference-3, plural radial ventilation holes are formed on a plate thereof, and each of the ventilation holes communicates with a voice coil gap. Further, an opening is formed at the center of a yoke. The air flows in and out between an inside of the speaker device and an outside thereof via each of the ventilation holes and the opening, and the speaker device is thereby cooled down.

As the speaker device of this kind, there is known a speaker device capable of flattening a sound pressure frequency characteristic to improve sound pressure by providing plural tiny holes on a protector integrated with the frame to cover the diaphragm (see Japanese Patent Application Laid-open No. 2004-266607, for example). Moreover, there is also known a speaker device in which plural rear surface holes are provided on the frame (see Japanese Patent Application Laid-open No. 58-53299, for example).

SUMMARY OF THE INVENTION

The present invention has been achieved in order to solve the above problems. It is an object of this invention to provide a speaker device capable of maintaining a ventilation hole and enlarging a setting space of a terminal on a frame.

According to one aspect of the present invention, there is provided a speaker device including a frame, the frame having one surface positioned on a side opposite to a sound output direction, an additional surface curved to the sound output direction from a peripheral end of the one surface, and an opening for ventilation, wherein the opening makes the one surface and the additional surface communicate with each other, and a terminal is arranged at a position covering the opening on the one surface.

The above speaker device includes the frame having the one surface positioned on the side opposite to the sound output direction, the additional surface curved to the sound output direction from the peripheral end of the one surface and the opening for the ventilation. In a preferred example, the one surface may correspond to a rear surface of the frame and the additional surface may correspond to a side surface of the frame, when a surface positioned in the sound output direction is assumed to be an upper surface on the frame. In addition, the terminal may be a relay terminal for electrically connecting the voice coil and an external circuit.

Particularly, the opening provided on the frame makes the one surface (e.g., the rear surface) and the additional surface (e.g., the side surface) communicate with each other, and the terminal is arranged at the position covering the opening of the one surface. Therefore, the opening on the one surface is covered, but the opening on the additional surface is open. Thus, ventilation performance of the speaker device is maintained. In addition, by such amount that the opening on the one surface is covered, the setting space of the terminal can be enlarged on the one surface.

In addition, the application of the configuration is particularly advantageous to a small-type speaker device. By enlarging an electrical contact area between an amplifier and the speaker device, kinds of speaker devices to which the configuration is applicable can be increased, which promotes flexibility of the speaker device. Hence, the speaker device can be preferably used as various kinds of speaker devices for information equipments such as a mobile phone, PDA and a laptop personal computer.

Moreover, if the configuration is employed, the frame can be formed at the low cost, as compared with a configuration (according to a comparative example) having an opening for ventilation only on a side surface of the frame.

Namely, by employing the configuration according to the comparative example, the same effect as that of the above speaker device can be expected, but there is a problem, which will be described below.

Generally, the frame is formed by such a method that two metal mold parts, i.e., a metal mold part for forming an upper surface thereof and a metal mold part for forming a lower surface thereof, are injection-molded. Thus, in such an injection-molding method as this, it is not easy to form the opening only on the side surface of the frame, and it is difficult to form the frame at low cost. Hence, it is problematic to form the frame having the configuration according to the comparative example in consideration of formability and cost. In this point, if the opening is formed to make the one surface (e.g., the rear surface) of the frame and the additional surface (e.g., the side surface) thereof communicate with each other like the above speaker device, it becomes possible to easily form the frame at low cost by the above injection-molding method.

In a preferred example, a step part in a step shape may be formed at a position corresponding to the opening on the one surface, and the terminal may be attached to the step part via an adhesive member. Instead of this example, a groove in a step shape may be formed at a position corresponding to the opening on the one surface, one end side of the terminal may be a part connected to an external circuit, and an additional end side of the terminal may be formed into a step shape to engage with the groove. Thereby, as compared with the above preferred example, work (number of processes) for mounting the terminal on the frame can be reduced, and accuracy of the contact position between the terminal and the external circuit can be improved.

In one manner, the speaker device may further include a magnetic circuit, wherein the frame has an inner wall formed into a frame shape and holding the magnetic circuit, and wherein the one surface substantially becomes flush with a rear surface of the magnetic circuit in such a state that the magnetic circuit is held by the inner wall.

This manner may include the magnetic circuit having the yoke, the magnet and the plate, for example. In addition, the frame has the inner wall formed into the frame shape and holding the magnetic circuit. In such a state that the magnetic circuit is held by the inner wall of the frame, the one surface of the frame substantially becomes flush with the rear surface of the magnetic circuit.

Therefore, when the setting space of the terminal can be sufficiently maintained on the one surface (e.g., the rear surface) of the frame, the amount of unnecessary setting space of the terminal can be used for enlarging the size of the magnetic circuit. Thereby, the magnetic circuit can be enlarged, and the sensitivity of the speaker device can be improved.

In another manner, the speaker device may further include a voice coil and a diaphragm having a recessed part for holding the voice coil, wherein an outer peripheral portion of the diaphragm is mounted on one end side of the additional surface positioned on the side opposite to the one surface, and wherein a space, which is formed between the diaphragm and the magnetic circuit and the space, communicates with the opening.

In this manner, the speaker device further includes the voice coil and the diaphragm having a recessed part for holding the voice coil. The outer peripheral portion of the diaphragm is mounted on the one end side of the additional surface (e.g., the side surface) positioned on the side opposite to the one surface (e.g., the rear surface), and the space is formed between the diaphragm and the magnetic circuit. At the same time, the space communicates with the opening. Thereby, since the ventilation performance in the speaker device becomes high, the inside of the device is cooled down, and it can be prevented that the pressure therein unnecessarily becomes high. Thereby, the diaphragm can smoothly move, and it can be prevented that the sensitivity becomes low.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

Now, preferred embodiments of the present invention will be described below with reference to the attached drawings.

First Embodiment

In the first embodiment, an opening for making the side surface and the rear surface communicate with each other is provided on the frame. Then, the terminal is arranged at the position covering the opening on the rear surface. Thereby, ventilation performance in the speaker device is ensured, and the setting space of the terminal on the frame is enlarged.

(Configuration of Speaker Device)

First, a description will be given of a configuration of a speaker device 100 according to a first embodiment of the present invention, with reference to FIG. 1A to FIG. 3.

Figure 1A:
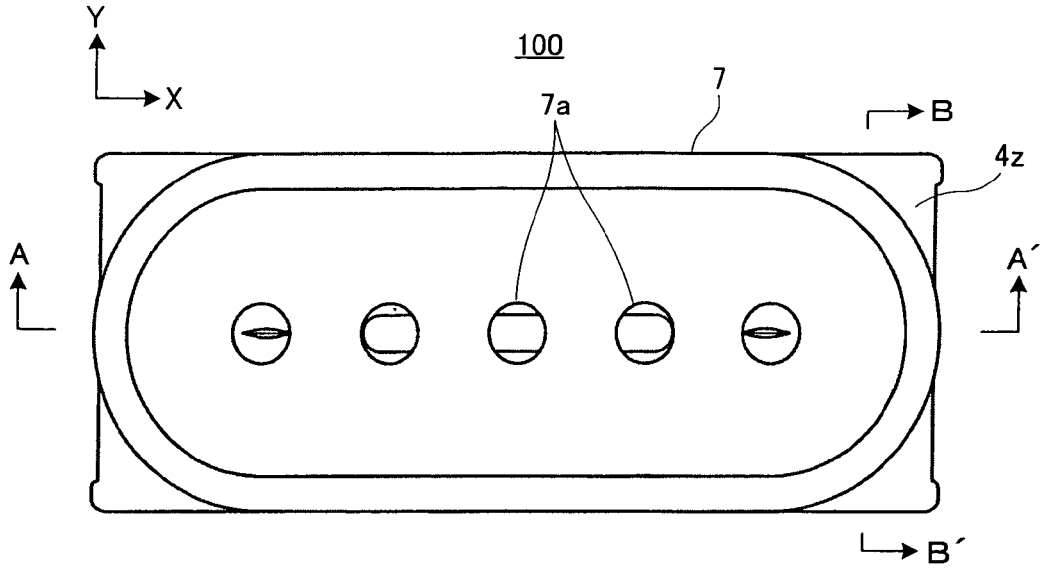
FIGS. 1A to 1C show a front view, a rear view and a side view of a speaker device according to a first embodiment of the present invention.
Figure 1B:
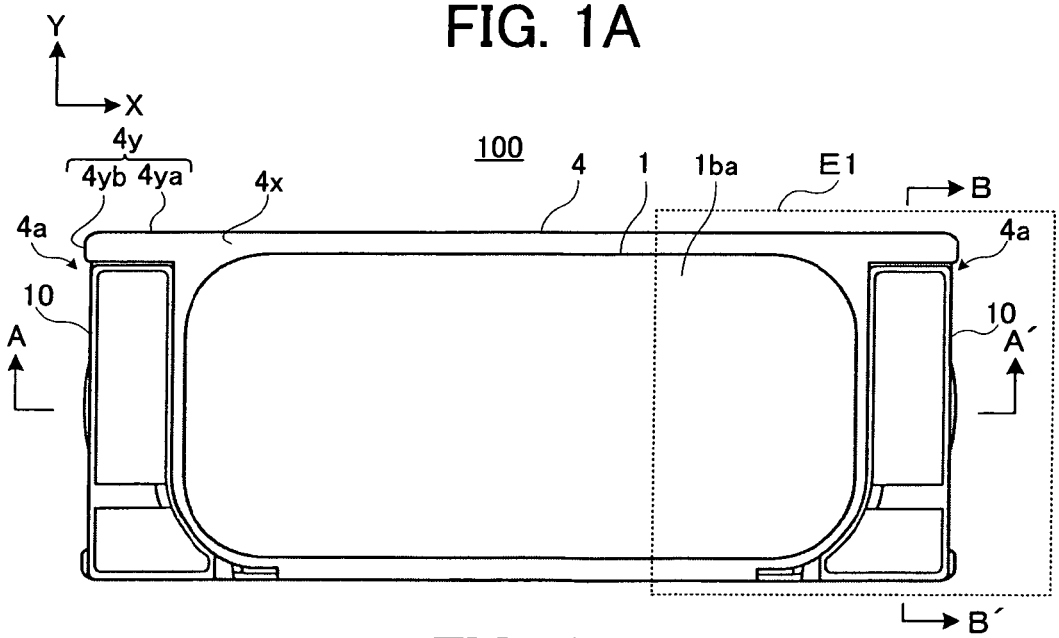
Figure 1C:
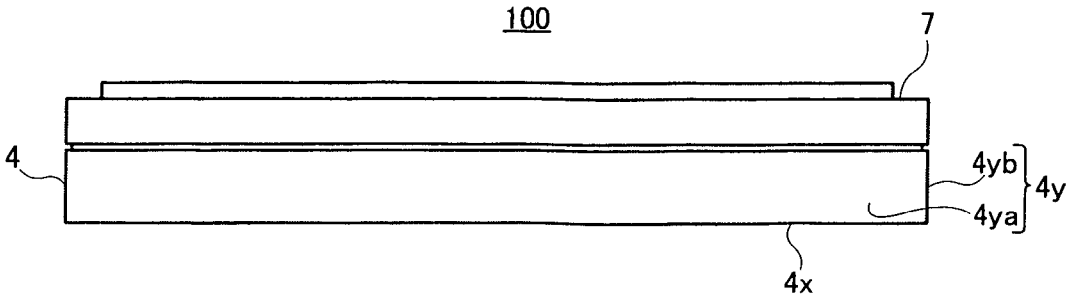
Figure 2A:
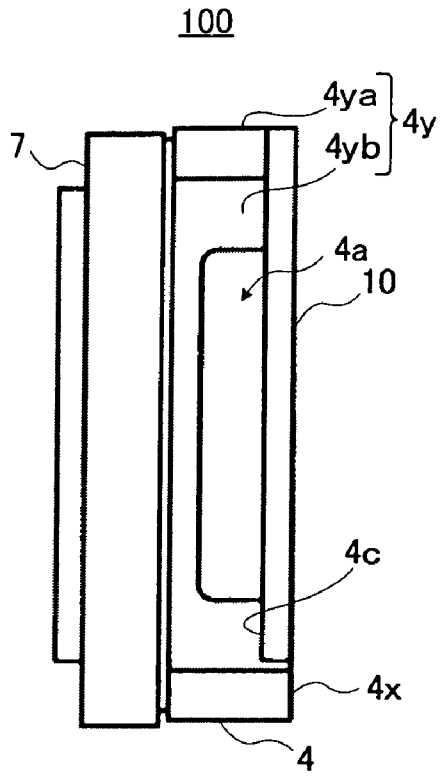
FIGS. 2A and 2B show a side view and a cross-sectional view of the vicinity of a terminal and an opening shown in FIGS. 1A to 1C.
Figure 2B:
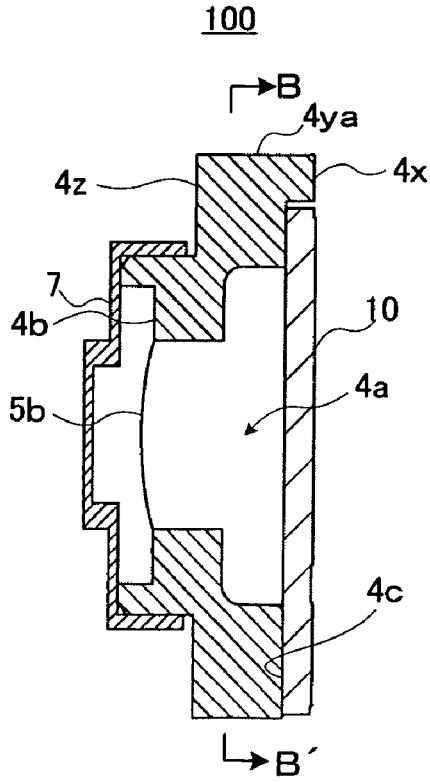
Figure 3:
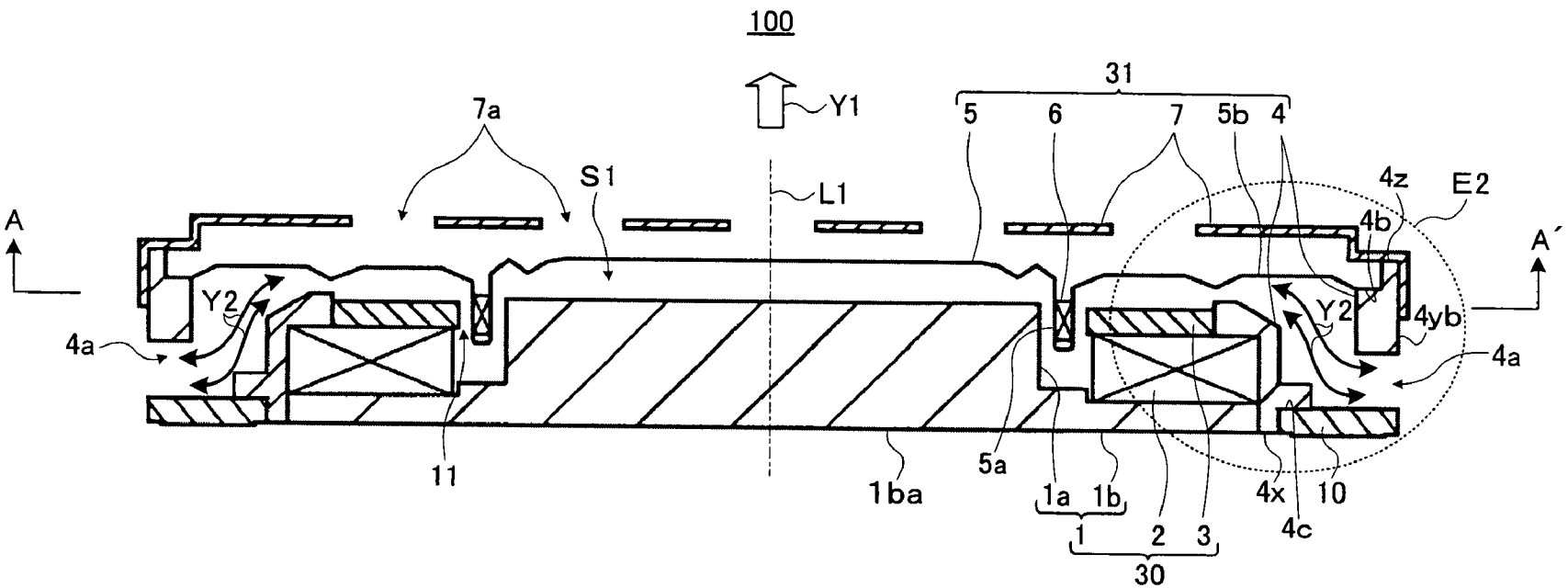
FIG. 3 shows a cross-sectional view of the speaker device taken along a cutting-line A-A' shown in FIGS. 1A and 1B.

FIG. 1A shows a front view of the speaker device 100. FIG. 1B shows a rear view of the speaker device 100. FIG. 1C shows a side view in a lateral direction of the speaker device 100 when the speaker device 100 shown in FIG. 1A is observed from a Y direction. FIG. 2A shows a side view in a longitudinal direction of the speaker device 100 when the speaker device 100 shown in FIG. 1A is observed in an X direction. FIG. 2B shows a cross-sectional view, taken along a cutting-line B-B', of the speaker device 100 shown in FIGS. 1A and 1B. FIG. 3 is a cross-sectional view, taken along a cutting-line A-A', of the speaker device 100 shown in FIGS. 1A and 1B, which is cut along a plane surface passing through a center of the lateral direction (Y direction) of the speaker device 100.

The speaker device 100 includes a magnetic circuit 30 having a yoke 1, a magnet 2 and a plate 3; a vibration system 31 having a diaphragm 5, a voice coil 6 and a case 7; a frame 4; and other members.

First, a description will be given of a configuration of the magnetic circuit 30. The magnetic circuit 30 is configured as an external-magnet type magnetic circuit.

The yoke 1 has a pole part 1*a* formed into a substantial pole shape, and a flange part 1*b* outwardly extending from a lower end portion of an outer peripheral wall of the pole part 1*a*. A rear surface 1*ba* of the yoke 1, positioned on a side opposite to the sound output direction (arrow Y1 direction), is formed into a substantially rectangular plane shape. The magnet 2, having an elongated annular shape and positioned at an appropriate position of the yoke 1, is arranged on the flange part 1*b* being a component of the yoke 1. The plate 3 formed into an elongated annular shape is arranged on the magnet 2. A magnetic gap 11 is formed in the vicinity of a position between an inner peripheral wall of the plate 3 and an outer peripheral wall of the pole part la being a component of the yoke 1.

Next, a description will be given of a configuration of the frame 4.

The frame 4 has a function to support various kinds of component parts forming the speaker device 100. The frame 4, which is formed into a frame shape, has a rear surface 4*x* positioned on the side opposite to the sound output direction (the arrow Y1 direction), a side surface 4*y* curved to the sound output direction (the arrow Y1 direction) from the peripheral end of the rear surface 4*x*, and an upper surface 4*z* curved to a side of a central axis L1 of the speaker device 100 from the one end side of the side surface 4*y*. As shown, the side surface 4*y* of the frame 4 has four side surfaces, i.e., two surfaces 4*ya* of which are positioned in the lateral direction of the frame 4, and other two surfaces 4*by* of which are positioned in the longitudinal direction of the frame 4. The length of each side surface 4*ya* in the X direction becomes longer than the length of each side surface 4*yb* in the Y direction. Step parts 4*b* of a step shape are formed on the upper surface 4*z* of the frame 4, and they support outer peripheral edge portions of an edge 5*b* which will be described later. The frame 4, whose inner wall contacts the outer peripheral wall of each component of the magnetic circuit 30, supports the magnetic circuit 30. The rear surface 4*x* of the frame 4 substantially becomes flush with the rear surface 1*ba* of the yoke 1. The frame 4 has characteristic components other than the above-mentioned components, which will be described later.

Next, a description will be given of a configuration of the vibration system 31.

The diaphragm 5 has a function to output the acoustic wave corresponding to an input signal. The diaphragm 5 is a dome-shaped diaphragm, which has a recessed part 5*a* having a substantially U-shaped cross-sectional shape and an edge 5*b*. The recessed part 5*a* is arranged at a position corresponding to the vicinity of the upper end portion of the outer peripheral wall of the pole part 1*a* and the vicinity of the inner peripheral wall of the plate 3, respectively. The voice coil 6 is held in the recessed part 5*a*. The edge 5*b*, connected with a part of the recessed part 5*a*, is arranged on the outer side of the recessed part 5*a*. An outer peripheral portion of the edge 5*b* is mounted on the step part 4*b* of the frame 4. Therefore, the edge 5*b* has a function to elastically support the voice coil 6 and the diaphragm 5 with respect to the frame 4. A space S1 is formed between the diaphragm 5 and the magnetic circuit 30. In this example, the diaphragm 5 and the edge 5*b* are integrally formed. However, this invention is not limited to this, and the diaphragm 5 and the edge 5*b* maybe separately or independently formed.

The voice coil 6 includes one wiring which has a plus lead wire and a minus lead wire (not shown), respectively. As described above, the voice coil 6 is held in the recessed part 5*a* of the diaphragm 5. In the voice coil 6, the plus lead wire is input wiring of an L(or R) channel signal, and the minus lead wire is input wiring of a grand(GND) signal. The plus lead wire and the minus lead wire are connected to a terminal 10, which will be described later. The terminal 10 is also connected to output wiring of an amplifier (not shown) or an external circuit (not shown). Thereby, signal and power of one-channel are inputted to the voice coil 6 from the amplifier via the terminal 10, the plus lead wire and the minus lead wire.

The case 7, formed into a cover shape, is arranged at a position covering the diaphragm 5 to be engaged with the vicinity of the upper end portion on the side surface 4*y* of the frame 4. The case 7 has plural openings 7*a*. Each of the openings 7*a* is formed at a position corresponding to the center in the lateral direction of the case 7 and aligned in the X direction with an appropriate space there between. Each of the openings 7*a* has a function to make the acoustic wave outputted from the diaphragm 5 outwardly pass.

As another member, there is the terminal 10 for relaying the signal and power outputted from the amplifier to the voice coil 6. The terminal 10 is provided at an appropriate position on the side of the rear surface 4*x* of the frame 4, which will be described later.

In the speaker device 100 having the above-mentioned configuration, the signal and power outputted from the amplifier is supplied to the voice coil 6 via the terminal 10 and the lead wiring including the plus lead wire and the minus lead wire of the voice coil 6. Thereby, driving power of the voice coil 6 is generated in the magnetic gap 11, which vibrates the diaphragm 5 in the direction of the central axis L1 of the speaker device 100. In this manner, the speaker device 100 outputs the acoustic wave in the direction of the arrow Y1.

(Mounting Configuration of Terminal on Frame)

Figure 4A:
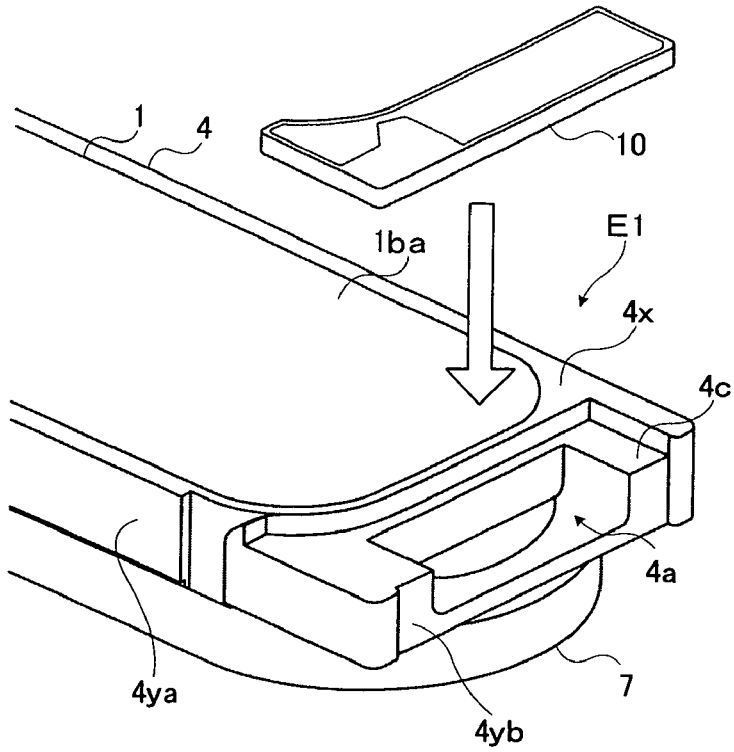
FIGS. 4A and 4B are partial perspective views showing a mounting method of the terminal on the frame according to the first embodiment.
Figure 4B:
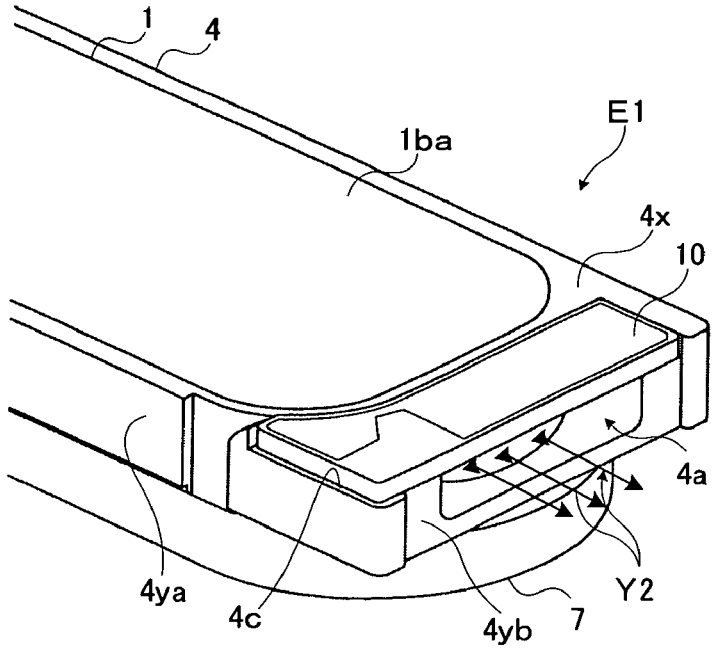

Next, a description will be given of the mounting configuration of the terminal 10 on the frame 4, with reference to FIG. 1B, FIGS. 2A and 2B to FIGS. 4A and 4B. FIG. 4A is a perspective view corresponding to a broken-area E1 in FIG. 1B, which explains the mounting method of the terminal 10 to a predetermined position on the rear surface 4*x* of the frame 4. FIG. 4B is a diagram corresponding to FIG. 4A, which shows such a state that the terminal 10 is mounted at the predetermined position on the rear surface 4*x* of the frame 4.

First, a description will be given of the configuration of the frame 4. The basic configuration of the frame 4 is described above. Therefore, a characteristic configuration of the frame 4 will be explained hereinafter.

The frame 4 has plural openings 4*a* communicating with the rear surface 4*x* and the side surface 4*yb* positioned in the longitudinal direction of the frame 4, and step parts 4*c* in a step shape, on the rear surface 4*x* and at the position corresponding to the openings 4*a*. The terminal 10 is attached to the step part 4*c* via an adhesive member (not shown).

Now, the mounting method of the terminal 10 will be briefly described. First, as shown in FIG. 4A, the terminal 10 is moved to the direction shown by an arrow in the drawing from the rear surface 4*x* side of the frame 4. Then, the terminal 10 is attached to the step part 4*c* of the frame 4 via the adhesive member (not shown). Such a state is shown in FIG. 4B. Thereby, the terminal 10 covers the opening 4*a* on the rear surface 4*x* side of the frame 4, but the terminal 10 does not cover the opening 4*a* on the side surface 4*yb* side of the frame 4. Therefore, the space S1 communicates with an external space of the speaker device 100. Thus, at the time of the operation of the speaker device 100, the air flows in and out (i.e., the air is ventilated) between the inside of the speaker device and the external space via the opening 4*a* positioned on the side surface 4*yb* of the frame 4.

Figure 5:
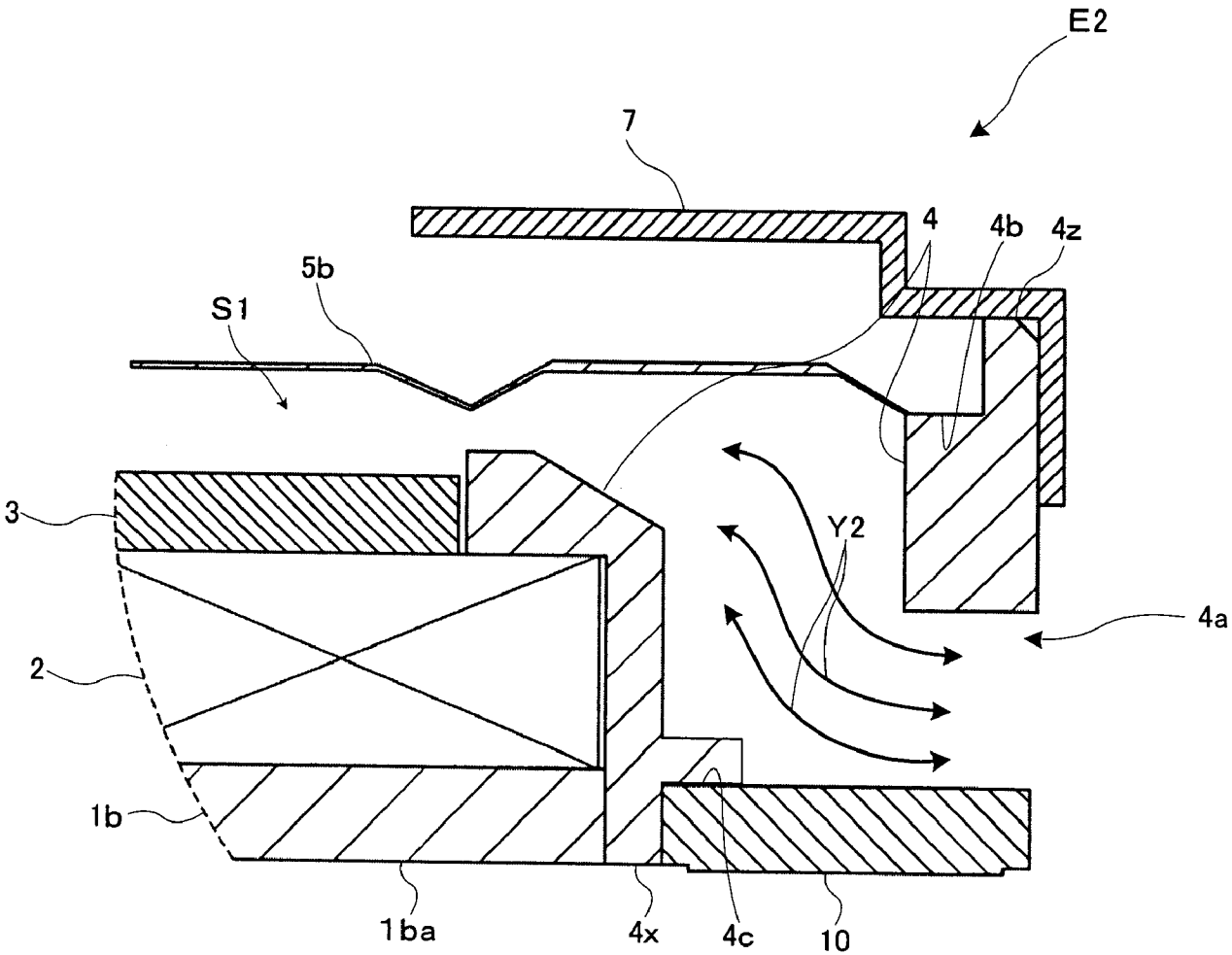
FIG. 5 is a partial cross-sectional view showing the vicinity of the terminal and the opening shown in FIG. 3.

Namely, in FIG. 3, at the time of the operation of the speaker device 100, when it is assumed that the diaphragm 5 moves to the direction of the arrow Y1, the air (outside air) existing in the external space flows into the space S1 via the opening 4*a*. That is, in this case, the outside air flows to the gap between the edge 5*b* and the plate 3 via the opening 4*a* on the side surface 4*yb* of the frame 4, as shown by an arrow Y2, and further passes through the magnetic gap 11 to flow into the gap between the diaphragm 5 and the pole part 1*a* (see FIG. 5 in which the broken-area E2 shown in FIG. 3 is enlarged, too). Meanwhile, when it is assumed that the diaphragm 5 moves to the direction opposite to the arrow Y1, the air existing in the space S1, which is heated by the voice coil 6, passes through an passage opposite to the above-mentioned passage to flow or be discharged to the external space via the opening 4*a* on the side surface 4*yb* of the frame 4, as shown by the arrow Y2. By this series of operation, since the ventilation performance in the speaker device 100 becomes high, the inside of the speaker device is cooled down, and it can be prevented that the pressure in the speaker device unnecessarily becomes high. Moreover, the diaphragm 5 can smoothly move. Thereby, deterioration of the sensitivity can be prevented. In this manner, it is understood that the opening 4*a* on the side surface 4*yb* of the frame 4 functions as the ventilation hole.

Next, a description will be given of characteristic operation and effect of the speaker device 100 according to a first embodiment of the present invention, as compared with the comparative example.

First, the comparative example will be explained. In the comparative example, the same reference numerals are given to the same components as those of the first embodiment, and explanations thereof are omitted or simplified.

Figure 6A:
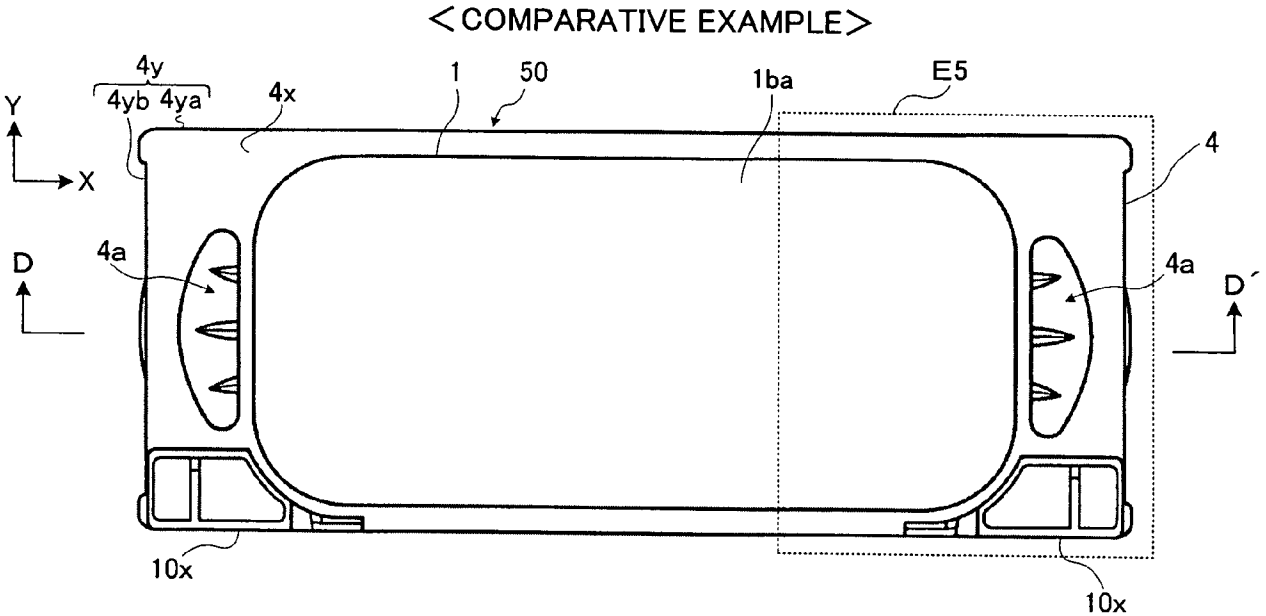
FIGS. 6A and 6B show a rear view and a cross-sectional view of a speaker device according to a comparative example.
Figure 6B:
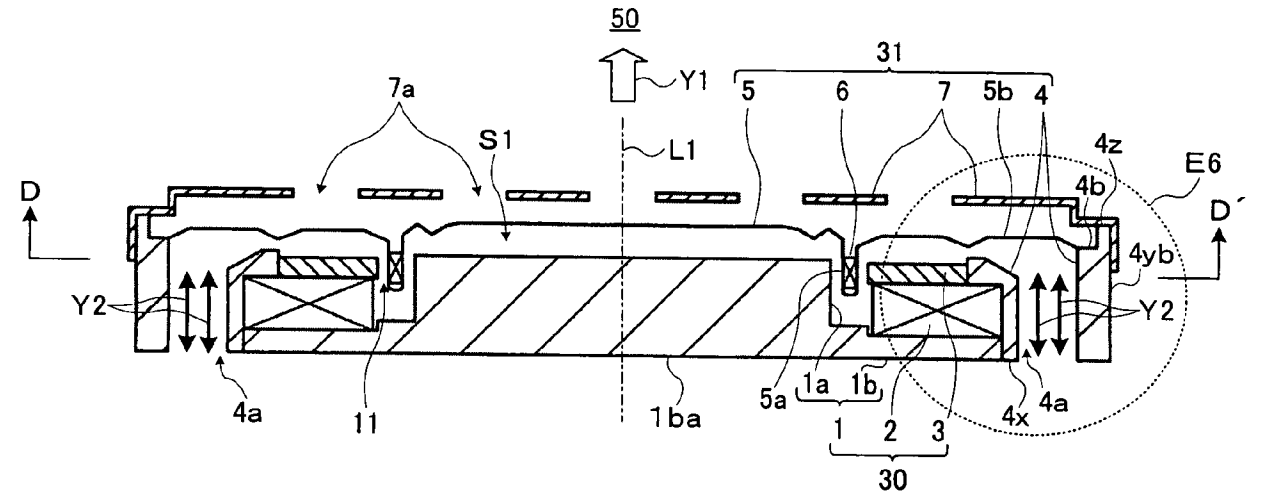
Figure 7B:
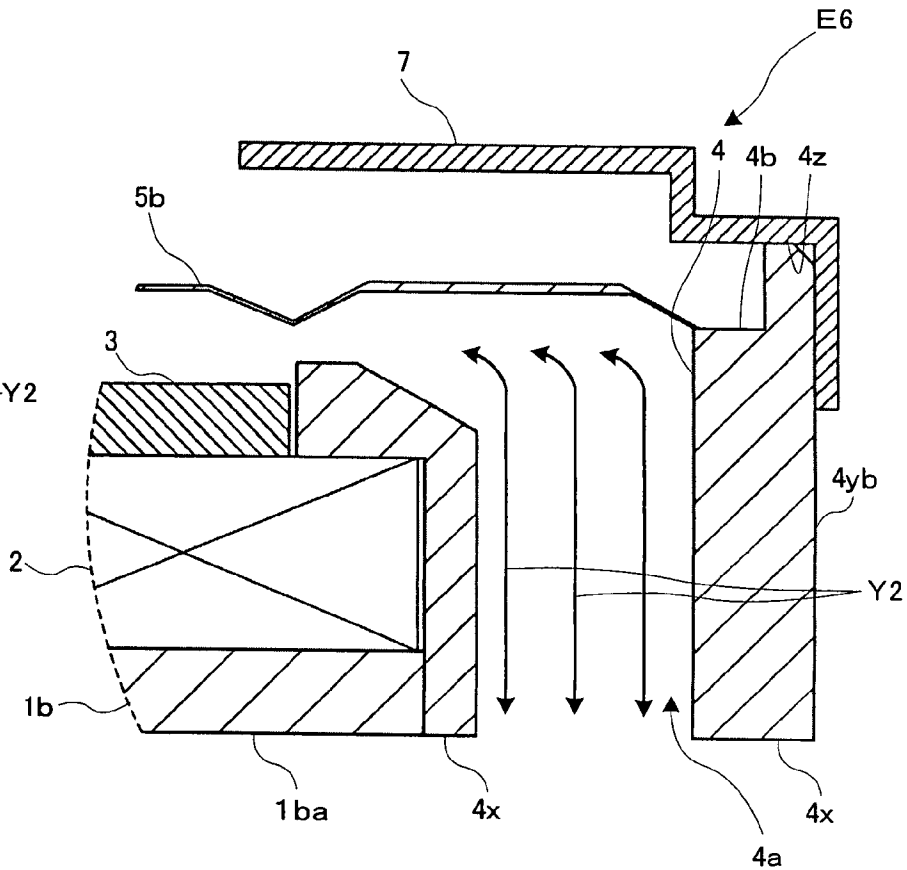
FIGS. 7A and 7B are a partial perspective view and a partial cross-sectional view of the vicinity of the terminal and the opening shown in FIGS. 6A and 6B.
Figure 7A:
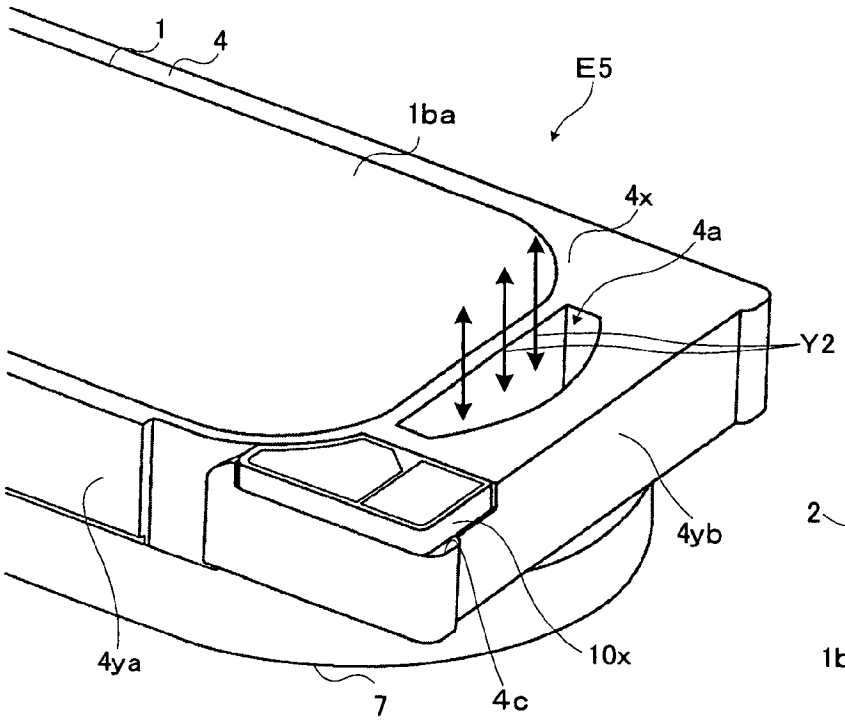

FIGS. 6A and 6B and FIGS. 7A and 7B show a configuration of the speaker device 50 having the mounting configuration of the terminal on the frame, according to the comparative example. FIG. 6A shows a rear view of the speaker device 50 according to the comparative example corresponding to FIG. 1B. FIG. 6B shows a cross-sectional view taken along a cutting-line D-D' shown in FIG. 6A. FIG. 7A is a perspective view showing the broken-like area E5 shown in FIG. 6A. FIG. 7B is a partial cross-sectional view showing a broken-line area E6 shown in FIG. 6B.

In the comparative example, the ventilation opening 4*a* is formed on the rear surface 4*x* of the frame 4, but no opening 4*a* is formed on the side surface 4*yb* of the frame 4. Namely, in the comparative example, the opening 4*a* does not communicate with both the rear surface 4*x* and the side surface 4*yb* of the frame 4, unlike the above first embodiment. Additionally, in the comparative example, the step part 4*c* is provided at a corner position on the rear surface 4*x* of the frame 4 and in the vicinity of the opening 4*a*, and a terminal 10*x* is attached thereto via the adhesive member (not shown) . In the comparative example having the above-mentioned configuration, at the time of the operation of the speaker device 50, the ventilation is performed between the space S1 in the speaker device 50 and the external space via the opening 4*a*, as shown by the arrow Y2.

In the comparative example having the configuration, as shown in FIG. 6A and FIGS. 7A and 7B, both of the opening 4*a* and the terminal 10 are provided on the rear surface 4*x* positioned in the vicinity of the side surface 4*yb* of the frame 4. Therefore, when the terminal having large size is necessary, it is difficult to enlarge the setting space of the terminal. In addition, by employing the configuration, if the downsizing of the speaker device is needed, it becomes more difficult to ensure the setting spaces of the terminal 10, the opening 4*a* and the magnetic circuit 30.

On the other hand, in the first embodiment of the present invention, the frame 4 has the opening 4*a* communicating with the rear surface 4*x* and the side surface 4*yb* positioned in the longitudinal direction of the frame 4, and the step part 4*c* formed on the rear surface 4*x* and at the position corresponding to each of the openings 4*a*. Thus, even in such a state that the terminal 10 is mounted on the step part 4*c* provided on the rear surface 4*x* of the frame 4 and the opening 4*a* on the rear surface 4*x* is covered, the ventilation opening 4*a* can be ensured on the side surface 4*yb* of the frame 4. If the configuration is employed, by such amount that no opening 4*a* is provided on the rear surface 4*x* of the frame 4, the setting space of the terminal 10 can be enlarged on the rear surface 4*x*. Therefore, in accordance with the first embodiment, it becomes possible that, on the frame 4, the ventilation opening 4*a* is ensured and the setting space of the terminal 10 is enlarged, which is remarkable as compared with the comparative example. In addition, when the setting space of the terminal 10 can be sufficiently ensured on the rear surface 4*x* of the frame 4, the amount of the unnecessary setting space of the terminal 10 can be assigned to the magnetic circuit 30 of large size. Hence, the magnetic circuit 30 can be enlarged, and, the sensitivity can be improved.

Particularly, application of the configuration is advantageous to a small speaker device. By enlarging an electric contact area between the amplifier and the speaker device, kinds of speaker devices to which the configuration is applicable can be increased, which enhances flexibility of the speaker device. Thus, the speaker device according to this invention can be preferably used for various kinds of information equipments such as the mobile phone, the PDA and the laptop personal computer.

Further, if the configuration is employed, the frame can be formed at low price, as compared with the configuration (according to an additional comparative example) in which the opening for the ventilation is provided only on the side surface of the frame.

Namely, if the configuration according to the additional comparative example is employed, the same effect as that of the first embodiment can be expected. However, at the same time, there is a problem as follows.

Generally, the frame is formed by such a method that the two metal mold parts, i.e., the metal mold part for forming the upper surface thereof and the metal mold part for forming the lower surface thereof, are injection-molded. Thus, in such an injection-molding method as this, it is not easy to form the opening only on the side surface of the frame, and it is difficult to form the frame at low price. Hence, it is problematic to form the frame having the configuration according to the additional comparative example in consideration of formability and cost. In this point, if the opening 4*a* is formed to make the rear surface 4*x* and the side surface 4*yb* of the frame 4 communicate with each other like the first embodiment, it becomes possible to easily form the frame at low price by the above injection-molding method.

Second Embodiment

Next, a description will be given of the configuration of the speaker device according to a second embodiment of the present invention, with reference to FIGS. 8A and 8B to FIG. 10. Hereinafter, the same reference numerals are given to the same components as those of the first embodiment, and only points different from the first embodiment will be explained.

Figure 8A:
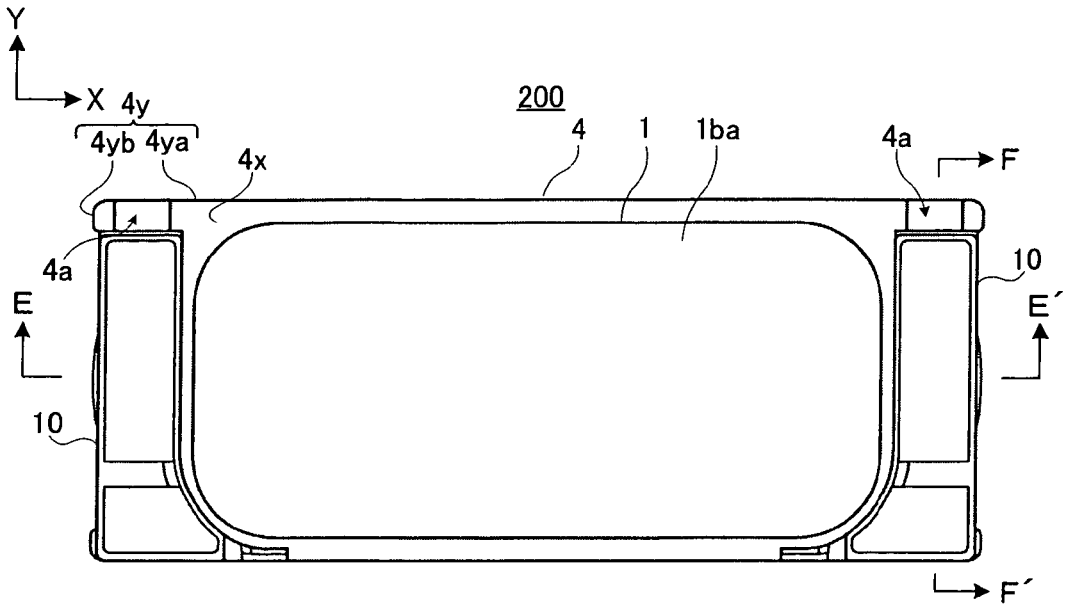
FIGS. 8A and 8B show a rear view and a side view of a speaker device according to a second embodiment of the present invention.
Figure 8B:
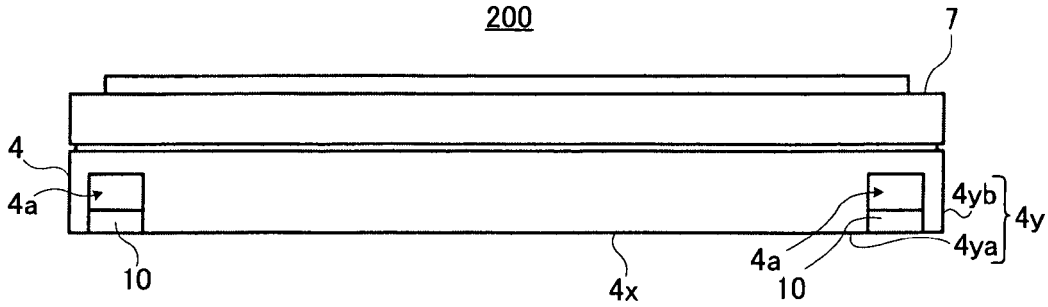
Figure 9:
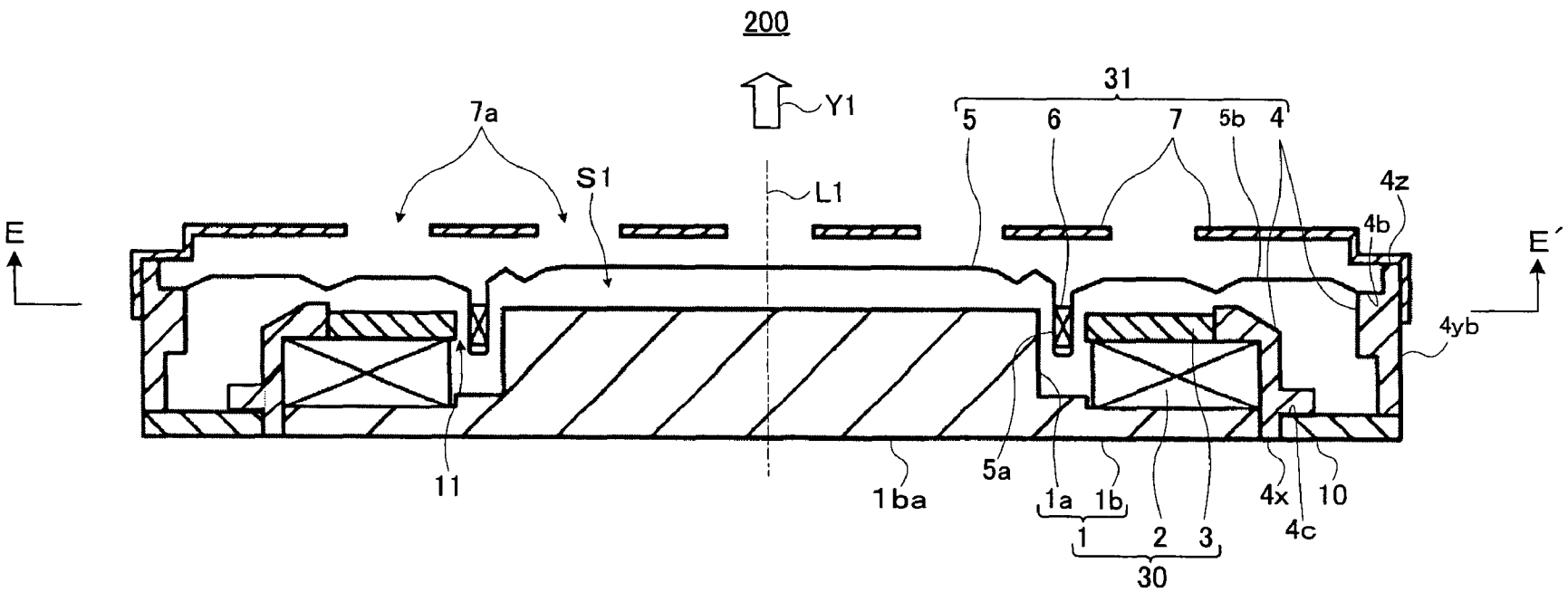
FIG. 9 shows a cross-sectional view of the speaker device taken along a cutting-line E-E' shown in FIG. 8A.
Figure 10:
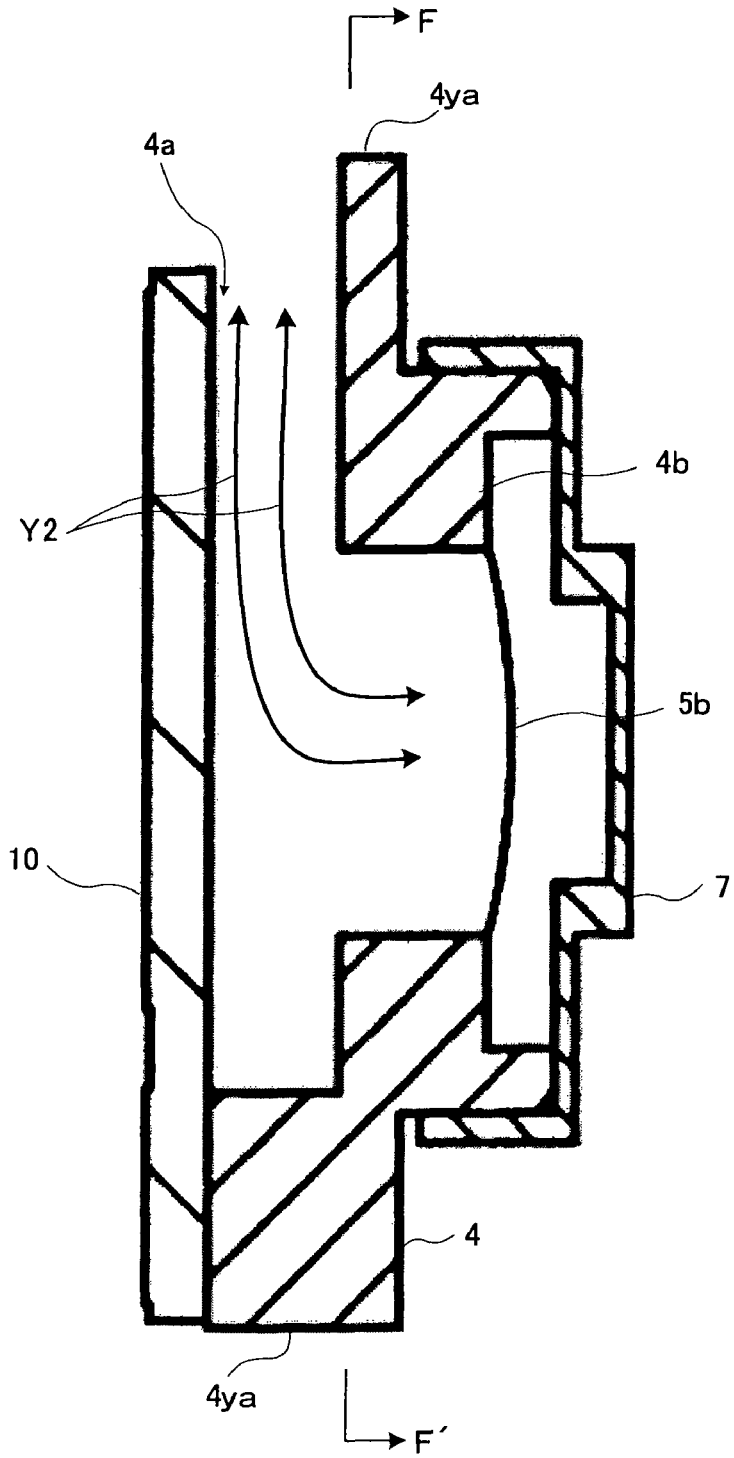
FIG. 10 shows a cross-sectional view of the speaker device taken along a cutting line F-F' shown in FIG. 8A.

FIG. 8A is a view showing the rear surface of a speaker device 200 according to the second embodiment, corresponding to FIG. 1B. FIG. 8B is a side view of the speaker device 200 shown in FIG. 8A when observed from the Y direction. FIG. 9 is a cross-sectional view of the speaker device 200 taken along a cutting-line E-E' shown in FIG. 8A. FIG. 10 is a cross-sectional view of the speaker device 200 taken along a cutting-line F-F' in FIG. 8A.

In the first embodiment, the ventilation opening 4*a* provided on the frame 4 is formed to make the rear surface 4*x* of the frame 4 and the side surface 4*yb* positioned in the longitudinal direction of the frame 4 communicate with each other. Meanwhile, in the speaker device 200 according to the second embodiment, the opening 4*a* provided on the frame 4 is formed to make the rear surface 4*x* of the frame 4 and the side surface 4*ya* positioned in the lateral direction of the frame 4 communicate with each other. This point is different between the first embodiment and the second embodiment.

Concretely, in the second embodiment, the opening 4*a* is provided in the vicinity of the side surface 4*yb* positioned in the longitudinal direction of the frame 4, on the rear surface 4*x* and at the corner position of the side surface 4*ya* positioned in the lateral direction of the frame 4. That is, in the second embodiment, no opening 4*a* is formed on the side surface 4*yb* positioned in the longitudinal direction, unlike the first embodiment. In the second embodiment having the configuration, at the time of the operation of the speaker device 200, the ventilation is performed between the space S1 in the speaker device and the external space via the opening 4*a*.

Therefore, in the second embodiment having the configuration, it becomes possible to obtain the same operation and effect as those of the first embodiment.

Third Embodiment

Next, a description will be given of a configuration of a speaker device 300 according to a third embodiment of the present invention, with reference to FIGS. 11A and 11B to FIG. 13. Hereinafter, the same reference numerals are given to the same components as those of the first embodiment, and only points different from the first embodiment will be simply explained.

Figure 11A:
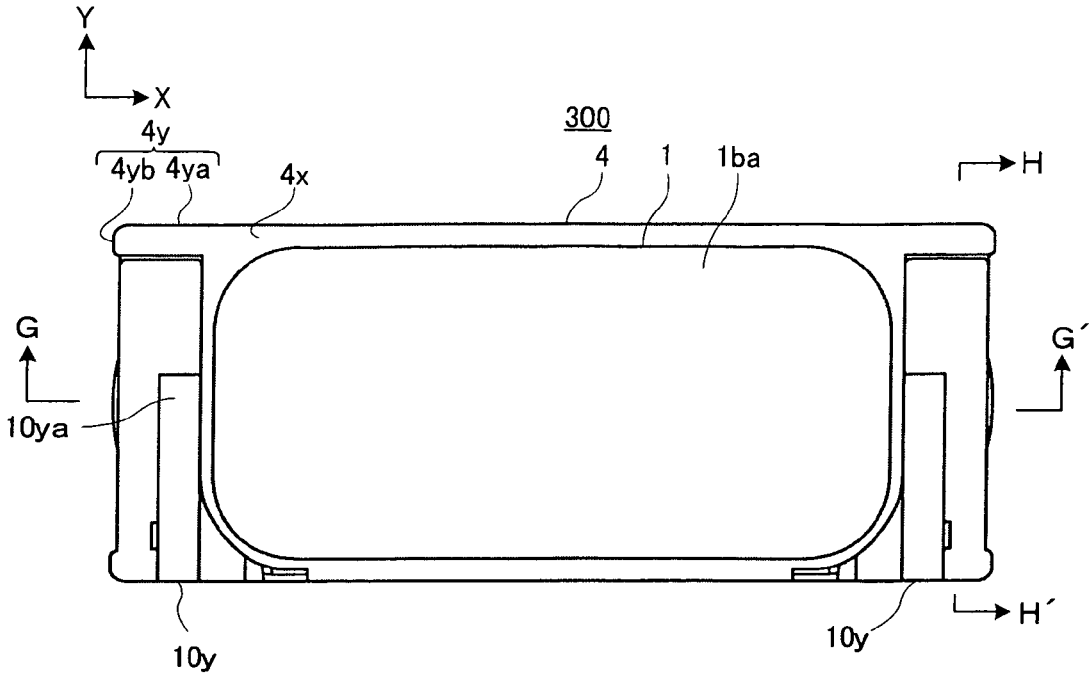
FIGS. 11A and 11B show a rear view and a cross-sectional view of the speaker device according to a third embodiment of the present invention.
Figure 11B:
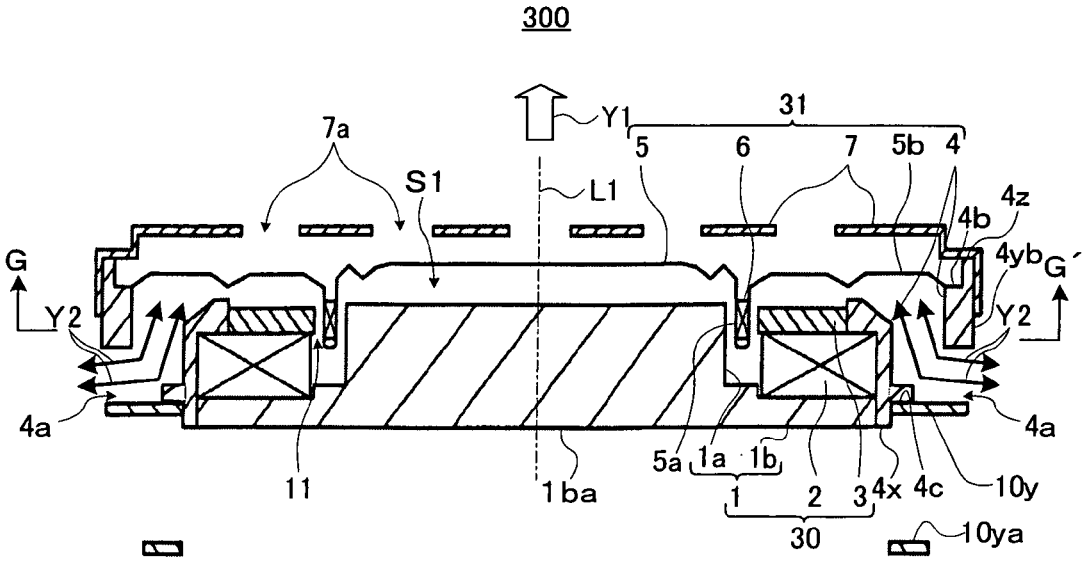
Figure 12A:
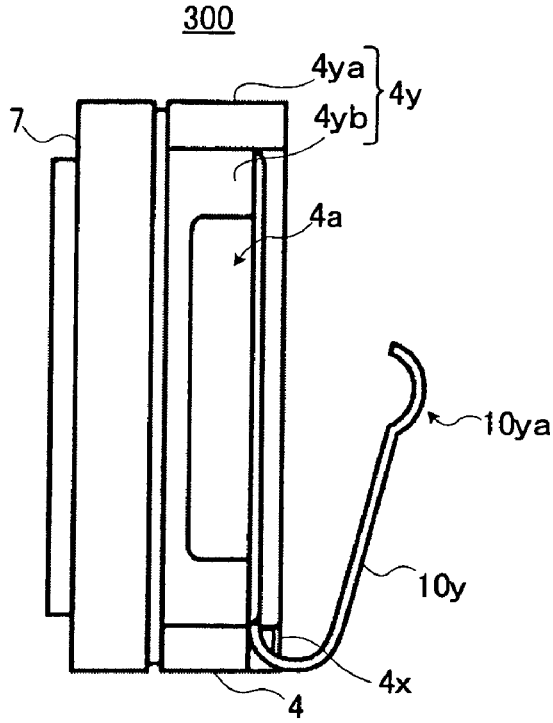
FIGS. 12A and 12B are a side view and a cross-sectional view showing the configuration of the vicinity of the terminal and the opening according to the third embodiment.
Figure 12B:
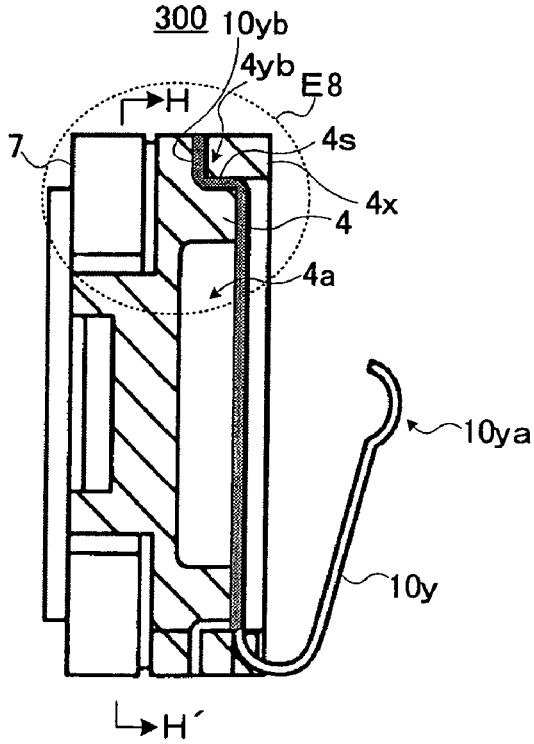
Figure 13:
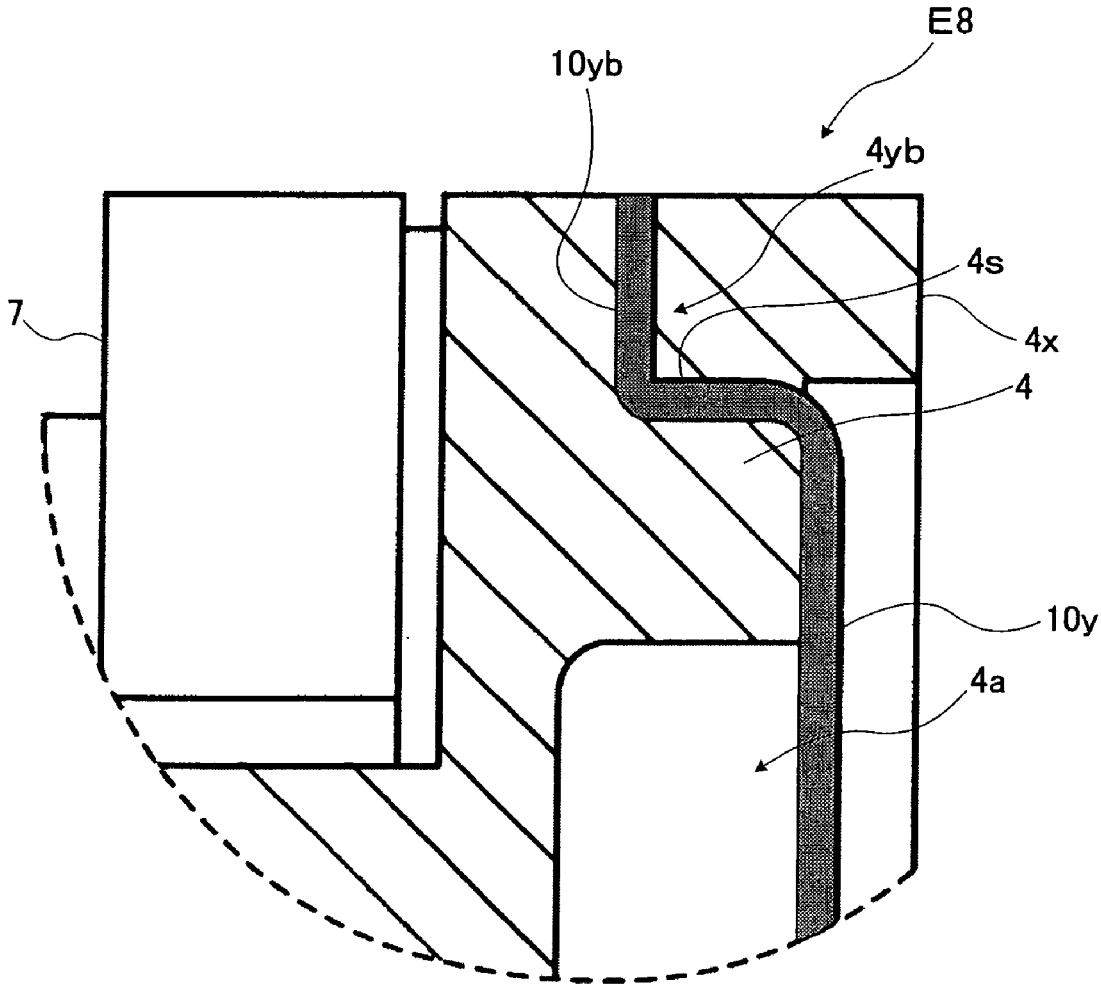
FIG. 13 is a partial cross-sectional view showing the mounting configuration of the terminal on the frame shown in FIGS. 12A and 12B.

FIG. 11A is a rear view of the speaker device 300 according to the third embodiment, corresponding to FIG. 1B. FIG. 11B is across-sectional view taken along a cutting line G-G' of the speaker device 300 shown in FIG. 11A. FIG. 12A is a side view of the speaker device 300 shown in FIG. 11A when observed from the X direction. FIG. 12B is a cross-sectional view of the speaker device 300 taken along a cutting-line H-H' shown in FIG. 11A. FIG. 13 is a partly-enlarged cross-sectional view corresponding to a broken-line area E8 shown in FIG. 12A.

In the first embodiment, the ventilation opening 4*a* provided on the frame 4 is formed to make the rear surface 4*x* of the frame 4 and the side surface 4*yb* positioned in the longitudinal direction of the frame 4 communicate with each other, which is common between the first embodiment and the third embodiment. However, the configuration of the terminal of the third embodiment is different from that of the first embodiment. Hence, the mounting method of the terminal on the frame 4 of the third embodiment is different from that of the first embodiment.

Namely, in the first embodiment, the terminal 10 formed into the plane shape is attached to the step part 4*c* provided at the position corresponding to the opening 4*a* on the rear surface 4*x* of the frame 4 via the adhesive member. Meanwhile, a terminal 10*y* of the third embodiment is not the terminal attached to the step part 4*c* of the frame 4, but a spring terminal of an insert-type, which is inserted into a groove of the frame 4 to be fixed. Since the spring terminal is generally known, a detailed explanation of the configuration is omitted.

Now, a description will be briefly given of the mounting method of the terminal 10*y* of the third embodiment on the frame 4. One end side 10*ya* of the terminal 10*y* is connected to the external circuit, and the other end side thereof is formed into a step shape, as shown in FIG. 12B and FIG. 13. Correspondently, a groove 4*s* formed into a step shape is formed at the position in the vicinity of the side surface 4*ya* corresponding to the lateral direction of the frame 4 and on the side of the rear surface 4*x*. Therefore, by inserting the other end side 10*yb* of the terminal 10*y* into the groove 4*s* provided on the rear surface 4*x* of the frame 4, the step-shaped part engages with the groove 4*s* to be fixed thereto. Thereby, the opening 4*a* on the rear surface 4*x* of the frame 4 is covered, and the opening 4*a* is formed only on the side surface 4*yb* positioned in the longitudinal direction of the frame 4.

Therefore, the same operation and effect as those of the first embodiment can be obtained. Like the manner of the third embodiment, by using the insert-type spring terminal, the work (number of processes) of mounting the terminal 10*y* on the frame 4 can be reduced as compared with the first embodiment, and accuracy of the contact position between the terminal 10*y* and the external circuit can be improved.

[Modification]

In the above first and third embodiments, in such a state that the terminal 10 or 10*y* is mounted on the predetermined position on the rear surface 4*x* of the frame 4, the ventilation opening 4*a* is provided on the side surface 4*yb* positioned in the longitudinal direction of the frame 4. In addition, in the above second embodiment, the ventilation opening 4*a* is formed in the vicinity of the side surface 4*yb* positioned in the longitudinal direction of the frame 4, on the rear surface 4*x* and at the corner position of the side surface 4*ya*. However, their positions are not limited to those of this manner. Namely, in the present invention, in such a state that the terminal is mounted on the predetermined position on the side of the rear surface 4*x* of the frame 4, the ventilation opening 4*a* may be provided at appropriate positions of the side surfaces 4*ys* and 4*yb* of the frame 4.

Additionally, in each of the above embodiments, this invention is applied to the speaker device having the rectangular plane shape. However, this invention is not limited to this manner. Namely, the present invention is applicable to speaker devices having various kinds of plane shapes such as a circle shape, a flat oval shape and an ellipse shape. In addition, in each of the above embodiments, the present invention is applied to the external-magnet type speaker device, which is not limited. Namely, the present invention is applicable to an internal-magnet type speaker device. As described above, the present invention can be modified within the contents thereof.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2005-296659 filed on Oct. 11, 2005 including the specification, claims, drawings and summary is incorporated herein by reference in its entirety.

What is claimed is:

1. A speaker device comprising a frame, the frame having one surface positioned on a side opposite to a sound output direction, an additional surface curved to the sound output direction from a peripheral end of the one surface, and an opening for ventilation, wherein the opening makes the one surface and the additional surface communicate with each other, and a terminal is arranged at a position covering the opening on the one surface, wherein a groove in a step shape is formed at a position corresponding to the opening on the one surface, wherein one end of the terminal is a part connected to an external circuit, and wherein an additional end of the terminal is formed into a step shape and engages with the groove.

2. The speaker device according to claim 1, wherein the frame further comprises an upper surface positioned on the sound output direction side, and wherein the one surface corresponds to a rear surface of the frame and the additional surface corresponds to a side surface of the frame.

3. The speaker device according to claim 1, further comprising a magnetic circuit, wherein the frame comprises an inner wall formed into a frame shape and holding the magnetic circuit, and wherein the one surface substantially becomes flush with a rear surface of the magnetic circuit in such a state that the magnetic circuit is held by the inner wall.

4. The speaker device according to claim 3, further comprising a voice coil and a diaphragm including a recessed part for holding the voice coil, wherein an outer peripheral portion of the diaphragm is mounted on one end side of the additional surface positioned on the side opposite to the one surface, and wherein a space, which is formed between the diaphragm and the magnetic circuit, communicates with the opening.

* * * * *